United States Patent [19]

Reed

[11] 4,154,394

[45] May 15, 1979

[54] VERTICAL CENTRIFUGE HAVING CONVEYOR VIBRATION DAMPER

[75] Inventor: Karl G. Reed, Wayne, Pa.

[73] Assignee: Pennwalt Corporation, Philadelphia, Pa.

[21] Appl. No.: 843,467

[22] Filed: Oct. 19, 1977

Related U.S. Application Data

[62] Division of Ser. No. 702,562, Jul. 6, 1976.

[51] Int. Cl.[2] ..... B04B 1/20

[52] U.S. Cl. ..... 233/7

[58] Field of Search ..... 233/1 A, 1 R, 1 C, 7; 308/26, 189 R, 238, 143, 145, DIG. 8, DIG. 9

[56] References Cited

U.S. PATENT DOCUMENTS

| | | | |
|---|---|---|---|
| 1,887,315 | 11/1932 | Lindgren | 308/143 |
| 2,179,824 | 11/1939 | Kip | 308/DIG. 8 |
| 2,606,082 | 8/1952 | Svensjo | 308/143 |
| 2,648,573 | 8/1953 | Wheildon | 308/DIG. 8 |
| 3,228,596 | 1/1966 | Reed | 308/143 X |
| 3,285,506 | 11/1966 | Reed | 233/7 X |
| 3,554,327 | 1/1971 | Takamura et al. | 308/26 X |
| 3,929,389 | 12/1975 | Riegler et al. | 308/DIG. 8 |

FOREIGN PATENT DOCUMENTS

| | | | |
|---|---|---|---|
| 779243 | 7/1957 | United Kingdom | 308/DIG. 9 |
| 859346 | 1/1961 | United Kingdom | 308/DIG. 9 |

*Primary Examiner*—George H. Krizmanich
*Attorney, Agent, or Firm*—Charles N. Quinn

[57] ABSTRACT

A vertical centrifuge has a conveyor vibration damper resiliently and asymmetrically biased against the centrifuge conveyor. The damper effectively damps the centrifuge bowl-conveyor assembly so the assembly does not approach resonant frequency during operation. The damper is dry and does not require lubrication.

6 Claims, 3 Drawing Figures

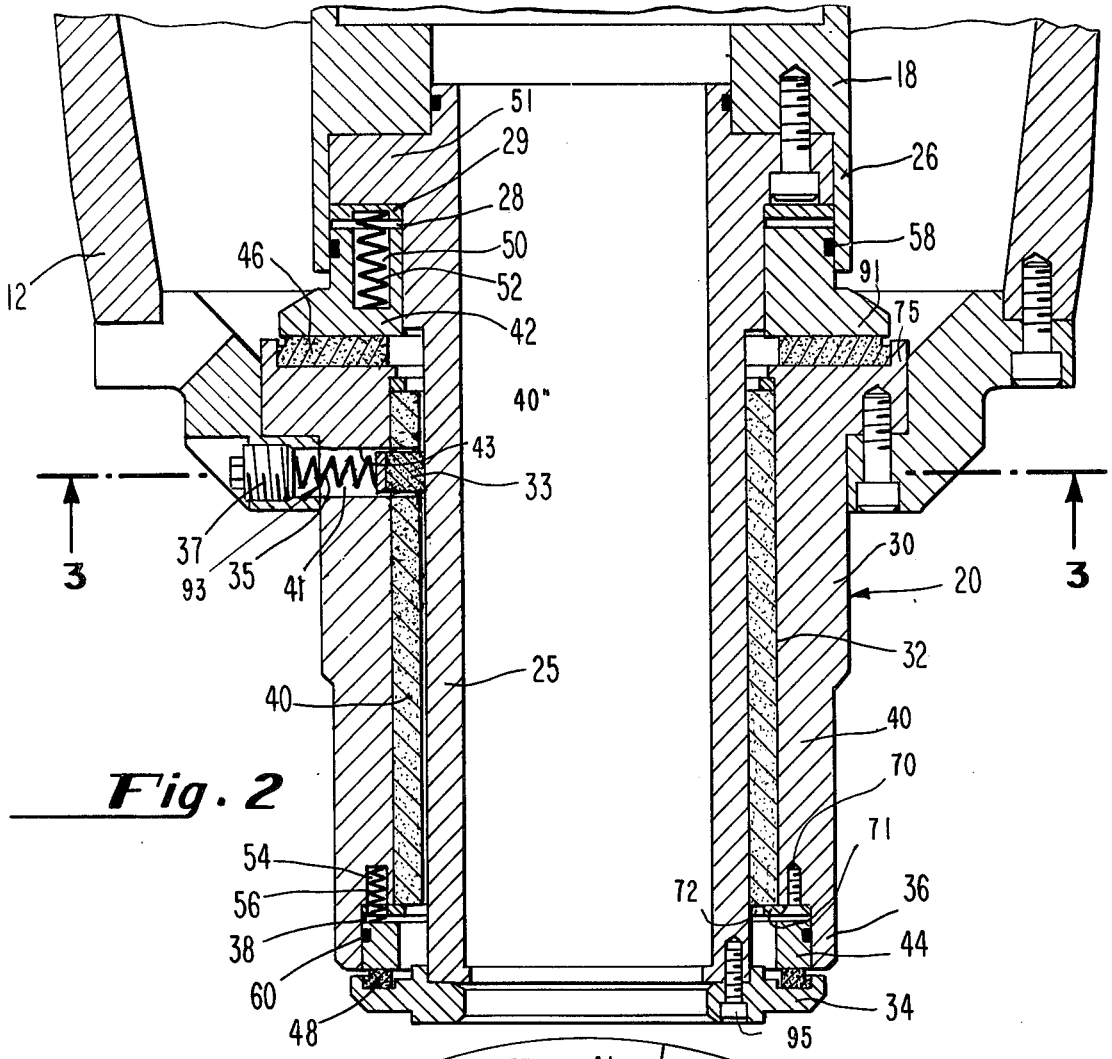
Fig. 2
Fig. 3
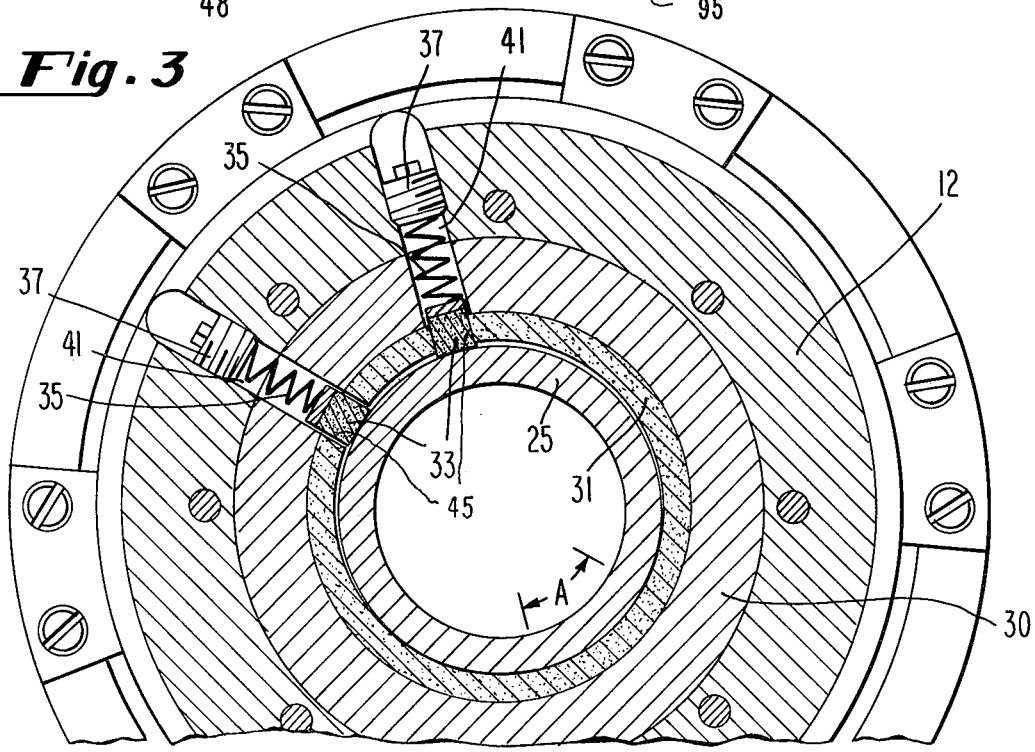

VERTICAL CENTRIFUGE HAVING CONVEYOR VIBRATION DAMPER

CROSS-REFERENCE TO RELATED PATENT APPLICATION

This application is a division of U.S. patent application Ser. No. 702,562 filed July 6, 1976 by Karl Gardner Reed and assigned to Pennwalt Corporation.

BACKGROUND AND DESCRIPTION OF THE PRIOR ART

This invention relates to vertical centrifuges of the continuous solids discharge type having a hollow bowl with a helical conveyor therewithin for moving the solids portion of a liquid-solid slurry toward a solids discharge port.

U.S. Pat. No. 3,285,506 discloses a dry thrust bearing at the lower end of the helical conveyor. The bearing operates successfully when the bearing is fabricated of a material such as polytetrafluoroethylene (e.g., "Teflon," a trademark of E. I. duPont de Nemours and Co.), which provides some damping. However, known dry self-damping bearing materials such as Teflon have an unacceptably short service life at high temperatures.

Accordingly, at ambient separation process temperatures above 275° F., a rigid bearing material, such as graphite, is required. When rigid materials are substituted, a phenomenon commonly referred to as rotor whirl develops as a result of dry friction when radial rubbing occurs in the thrust bearing. This phenomenon manifests itself as a vibration of the conveyor. As frequency of conveyor vibration approaches the resonant frequency, conveyor vibration can become violent and highly destructive; mechanical parts may be damaged or destroyed.

Conveyor vibration occurs most frequently during test operation of the centrifuge when no solid-liquid slurry is in the centrifuge. To prevent damage to the centrifuge during such operation, self-induced vibratory resonance of the conveyor must be avoided.

SUMMARY OF THE INVENTION

The present invention is for a dry damper which radially, resiliently biases a damper plug against the centrifuge helical conveyor to thereby damp the conveyor, preventing excessive vibration thereof. The disclosed damper requires no lubrication.

BRIEF DESCRIPTION OF THE DRAWINGS

FIG. 2 is an enlarged sectional view of a portion of FIG. 1

FIG. 3 is a broken sectional view of a preferred embodiment of the invention, taken along arrows 3—3 in FIG. 2.

DESCRIPTION OF THE PREFERRED EMBODIMENTS

Figure 1:
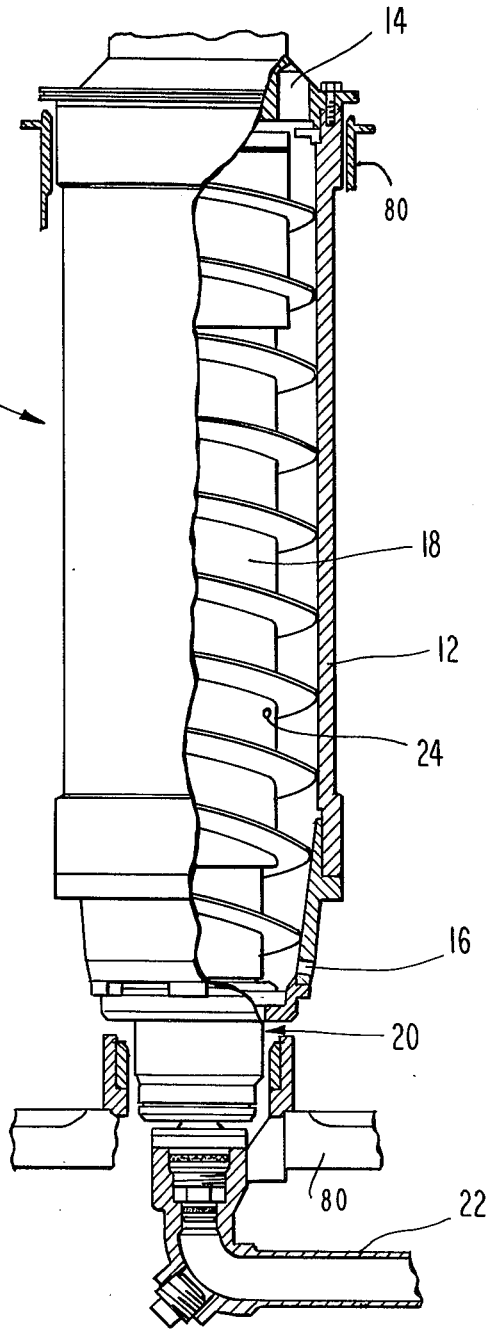
FIG. 1 is an elevational view partly in section of a vertical centrifuge embodying the invention.

Referring to FIG. 1, a vertical centrifuge, generally denoted 10, comprises a vertically elongated hollow bowl 12, for receiving and separating a solids-liquid mixture and having a liquid discharge port 14 and a solids discharge port 16. Bowl 12 contains a helical screw conveyor 18 mounted for rotation with respect to bowl 12 on an upper bearing assembly (not shown) and a lower dry radial thrust bearing designated generally by numeral 20. A feed tube 22 supplies the solids-liquid slurry which enters bowl 12 through opening 24 in conveyor 18. Bowl 12 is rotatably mounted in a housing 80 which has been substantially entirely broken away in FIG. 1 to show the bowl and conveyor. During operation bowl 12 and conveyor 18 are driven at different speeds within the housing by conventional drive means which are not shown.

FIG. 2 is a sectional view of lower dry radial thrust bearing 20, which facilitates rotation of the conveyor with respect to the bowl. Bearing 20 includes a coaxially downwardly extending cylindrical journal 25 portion of conveyor 18. Conveyor 18 presents a downwardly extending lip 26 spaced annularly outward from cylindrical journal 25 to provide mating of cylindrical journal 25 with the main, upper portion of conveyor 18.

Bearing assembly 20 also includes a hollow downwardly coaxially extending hub portion 30 of bowl 12. The hub presents a circular central opening 32 with an annular wall, with the opening receiving an annular sleeve 40. Cylindrical journal 25 is received in the interior of annular sleeve 40 and has an outwardly extending annular shoulder projection 34 secured to the journal by screws 95; hub 30 is formed with a downward annular flange 36 spaced annularly outwardly from the cylindrical exterior of journal 25 to provide a downwardly facing pocket 38.

Annular sleeve 40 is preferably formed of a rigid dry bearing material such as carbon, graphite, bronze or a composite of carbon and graphite, and surrounds and engages cylindrical journal 25 in the area above annular flange 36. An upper mating ring 42 forms a downwardly facing annular shoulder 91 of conveyor 18 and surrounds cylindrical journal 25 above annular sleeve 40 while a lower mating ring 44 surrounds cylindrical journal 25 below annular sleeve 40. These upper and lower mating rings 42 and 44 fit respectively in pockets 28 and 38. An upper annular thrust ring washer 46 is provided intermediate upper mating ring 42 and hub 30 while a lower annular thrust ring washer 48 is between lower mating ring 44 and outward annular shoulder projection 34. Thrust ring washers 46 and 48, which can be readily replaced as required, are preferably resilient plastic material such as reinforced polytetrafluoroethylene but may be the same materials as annular sleeve 40 if so desired. Preferably, annular thrust ring washer 46 rests on hub 30 while thrust ring washer 48 rests on annular shoulder projection 34. Annular thrust ring washer 46 receives the weight of conveyor 18 and is retained in place by a concentric annular shoulder 75 formed in hub 30. Thus, annular thrust ring washer 46 rotates unitarily with bowl 12.

Annular sleeve 40 is secured to hub 30 for unitary rotation therewith by the action of screws 70, threaded into hub 30, which retain abutment shims 71 in contact with the lower annular margin 72 of annular sleeve 40. Shims 71 urge annular sleeve 40 upwards, as best shown in FIG. 2, into contact with an unnumbered shoulder portion of hub 30.

At annularly spaced intervals upper mating ring 42 presents apertures 50 which receive compression springs 52 which urge upper mating ring 42 downward toward hub 30 so the mating ring lower face is in running contact with annular thrust ring washer 46. An annular spring retaining plate 29 is retained against a horizontal flange portion 51 of cylindrical journal 25 by springs 52 which fit into suitable apertures (not numbered) in spring retaining plate 29. Hub 30 is formed with openings 54 to receive compression springs 56 which resiliently urge lower mating ring 44 downward toward outward annular shoulder projection 34 so the lower face of ring 44 is in running contact with annular thrust ring washer 48. The lower faces of mating rings 42 and 44 are highly polished.

The outer annular surfaces about mating rings 42 and 44 receive resilient O-rings 58 and 60. Upper O-ring 58 engages lip 26 thereby sealingly connecting upper mating ring 42 and helical conveyor 18. Lower O-ring 60 engages lip 36 thereby sealingly connecting lower mating ring 44 and hub 30. The seals are liquid-tight and thus serve as means for fluid-insulating the lower dry radial thrust bearing 20 and a conveyor damper, described below, from any solids-liquid mixture within bowl 12.

At least one pin (not shown) couples upper mating ring 42 with cylindrical journal 25 so that ring 42 rotates with cylindrical journal 25 but remains free to float axially with respect to cylindrical journal 25. The pin also forces spring retaining plate 29 to rotate with cylindrical journal 25, thereby retaining springs 52 in alignment.

No lubrication is necessary for annular sleeve 40. To keep abrasives in the process atmosphere away from the annular sleeve clearances, the mating ring and annular thrust ring washer combinations 42, 46 and 44, 48 seal off the annular sleeve area. Were the mating ring and annular thrust ring washer combinations not provided, abrasives from the separation process environment could find their way into the clearance between annular sleeve 40 and cylindrical journal 25 and cause wear on one or both elements A dry conveyor damper designated generally 93 damps unwanted vibration which occurs in the conveyor during operation of the centrifuge with no solids-liquid slurry throughput. The conveyor damper includes a dry conveyor damper plug 33 which is biased against cylindrical journal 25 by resilient biasing means 35, where plug 33 and resilient means 35 are both resident in a radial cavity 41 formed in hollow cylindrical hub 30. The closed bottom of radial cavity 41 is preferably formed by an adjustably positionable cavity closing plug means 37 threadably engaged with the wall of cavity 41. Threaded closing plug 37 serves as means for adjusting compression of resilient means 35, which is preferably a coil spring; as plug 37 is rotated and thereby moves radially in or out of cavity 41, compression of resilient means 35 is changed. Both resilient means 35 and damper plug 33 are slideably resident within cavity 41; the wall 43 of cavity 41 restrains resilient means 35 and damper plug 33 from moving in any direction other than the radial direction.

In FIGS. 2 and 3, annular sleeve 40 is shown to have at least one and preferably a plurality of holes 45 therethrough, each for residence and slideable passage therethrough of a moveable-conveyor contact plug 33. Plug 33, being biased against cylindrical journal 25 by plug bias spring 35 acts as a damper opposing vibration of spindle 25. Plugs 33 are preferably the same material as annular sleeve 40.

A plurality of plug 33 and bias spring 35 combinations may be provided in hub 30 about cylindrical journal 25, asymmetrically spaced about the axis of rotation of the conveyor to bias the cylindrical journal against annular sleeve 40.

A two plug-bias spring combination is illustrated in FIG. 3. Damper plugs 33 slightly displace the helical conveyor in the radial direction as they bias cylindrical journal 25 against annular sleeve 40 in the area denoted by arcuate arrow A. This bias and resultant contact of the cylindrical journal with damper plugs 33 and annular sleeve 40 provides sufficient damping so that no significant conveyor vibration occurs during centrifuge operation. Any number of plug and plug spring combinations could be used so long as they are disposed asymmetrically about the axis of rotation of the conveyor to bias cylindrical journal 25 against annular sleeve 40.

Variations in construction from the embodiments illustrated have been used successfully. In another embodiment, not illustrated, annular sleeve 40 has been separated into upper and lower portions with the upper portion biased asymmetrically against the cylindrical journal by spring means. Annular sleeve 40 may also be constructed in multiple arcuate segments, rather than the illustrated one piece construction, to facilitate insertion into the hub. In yet another embodiment annular sleeve 40 may be constructed of a stainless steel-polyimide sandwich with the polyimide formed into discrete inwardly facing circumferentially spaced buttons contacting cylindrical journal 25.

Because the disclosed dry bearing and dry conveyor damper need no lubrication, if the materials are not temperature limited, there is virtually no restriction on process temperatures with which the centrifuge may be used. Additionally, because no lubrication is required, the bearing and damper are not vulnerable to attack by process vapors which may be present.

Variations, including reversals of parts from those shown and other modifications, fall within the scope of this invention. The above particular description is by way of illustration and not of limitation. Changes, omissions, additions, substitutions, and/or other modifications may be made without departing from the spirit of the invention. Accordingly, it is intended that the patent shall cover, by suitable expression in the claims, the various features of patentable novelty that reside in the invention.

Having thus described my invention, I claim the following:

1. A vertical centrifuge including:

(a) a vertically elongated bowl, rotatable about a vertical axis, for receiving and separating a solids-liquid mixture, having a hollow cylindrical hub extending coaxially downwardly therefrom with a radial cavity therein having an open end terminating at said hub hollow interior;

(b) a screw conveyor within said bowl and rotatable about a vertical axis with respect thereto, having a cylindrical journal extending coaxially downwardly therefrom, said screw conveyor within said bowl being radially displaceable with respect to said bowl;

(c) a dry radial thrust bearing facilitating rotation of said conveyor with respect to said bowl, comprising:

(i) an annular rigid sleeve resident within said hub and rotatable unitarily therewith, said cylindrical journal being rotatably resident within said sleeve, said cylindrical journal within said annular sleeve being radially displaceable, unitarily with said screw conveyor, with respect to said sleeve to arcuately contact said sleeve, at least a central portion of said sleeve within which said journal resides being devoid of viscous lubricants; and (ii) an annular ring between a downwardly facing annular shoulder of said conveyor and an upwardly facing annular shoulder of said bowl; and (d) a dry conveyor damper, rotatable unitarily with said bowl, for radially displacing said screw conveyor within said bowl by biasing said journal arcuately against said sleeve, comprising:

(i) a rigid damper plug radially biased against said journal, urging said journal into arcuate contact against said sleeve at a position substantially diametrically opposite said damper plug by radially displacing said conveyor within and with respect to said bowl, partially protruding from and slideably resident within said cavity;

(ii) solid phase resilient spring bias means for radially biasing said plug against said journal, resident within and constrained against other than radial movement by walls of said cavity.

2. The centrifuge of claim 1 wherein said annular sleeve and said annular ring are both secured to and rotatable unitarily with said bowl.

3. The centrifuge of claim 1 wherein said annular sleeve has a radially disposed hole therethrough coaxial with said radially disposed cavity in said hub and wherein said damper plug protrudes from said hole through said sleeve and is slideably resident within both said radially disposed hole in said sleeve and said radially disposed cavity in said hub.

4. The centrifuge of claim 1 wherein said resilient means is a spring compressed in said radially disposed cavity, between the cavity bottom and said damper plug.

5. The centrifuge of claim 4 further comprising an adjustably positionable cavity closing plug means, rotatable unitarily with said bowl and hub and forming the closed end of said cavity, for adjusting compression of said spring.

6. The centrifuge of claim 1 further comprising means for fluid-insulating said conveyor damper from said solids-liquid mixture in said bowl.

* * * * *